United States Patent [19]

Walker

[11] Patent Number: 5,048,547

[45] **Date of Patent: * Sep. 17, 1991**

[54] NAIL POLISH REMOVER CONTAINER

[75] Inventor: Alvin M. Walker, Clearwater, Fla.

[73] Assignee: Walker Marketing, Inc., Clearwater, Fla.

[ * ] Notice: The portion of the term of this patent subsequent to Apr. 11, 2006 has been disclaimed.

[21] Appl. No.: 289,671

[22] Filed: Dec. 27, 1988

[51] Int. Cl.[5] ..... A45D 29/20

[52] U.S. Cl. ..... 132/75; 132/73.5; 401/10; 401/122; 206/229; 206/581

[58] Field of Search ..... 132/73, 73.5, 75, 74.5; 401/122, 10; 206/229, 581

[56] References Cited

U.S. PATENT DOCUMENTS

| | | | |
|---|---|---|---|
| 3,369,266 | 2/1968 | Willson | 132/75 |
| 4,022,228 | 5/1977 | Ropp et al. | 132/75 |
| 4,321,936 | 3/1982 | Chaconas | 132/73.5 |
| 4,802,797 | 2/1989 | Cole | 401/122 |
| 4,819,672 | 4/1989 | Walker et al. | 132/73.5 |

FOREIGN PATENT DOCUMENTS

| | | | |
|---|---|---|---|
| 0049759 | 4/1982 | European Pat. Off. | 132/73 |

*Primary Examiner*—Gene Mancene
*Assistant Examiner*—Adriene B. Lepiane
*Attorney, Agent, or Firm*—John S. Hale

[57] ABSTRACT

A manicuring device adapted for removing fingernail polish comprising a cylindrical receptacle defining an interior chamber with a plurality of integral bristle members spaced in rows and projecting inward to define a finger insertion area.

2 Claims, 2 Drawing Sheets

NAIL POLISH REMOVER CONTAINER

BACKGROUND OF THE INVENTION

The prior art contains many patents directed to nail polish removal receptacles which support or suspend an insert structure to aid in the removal of hardened nail polish from fingernails after the finger has been immersed into nail polish remover contained within the receptacle. U.S. Pat. Nos. 4,474,195; 4,440,181 and 4,282,891 disclose nail polish remover devices in which a receptacle is provided with a sponge or sponge-like absorbent member insert. The sponge member insert is provided with an aperture forming a finger hole into which the finger is placed. The absorbent sponge absorbs nail polish remover and upon insertion of finger into the sponge aperture, the polished fingernail comes into contact with the sponge and nail polish remover solution to remove the polish from the nail. The solution and polish fragments are wiped from the inserted fingernail by the sponge as the fingernail is removed from the jar.

U.S. Pat. No. 4,397,324 discloses a nail polish receptacle which is provided with a brush member. The brush member is disposed in the receptacle by wire legs which support the brush element in the approximate determinus of a circular finger opening. U.S. Pat. No. 4,321,931 discloses a nail polish remover receptacle containing a plurality of downwardly spaced apart free floating legs with an inwardly curved end portion. The legs have bristles or brush like elements secured thereto which extend inward. When a person inserts a finger into the device, the finger will contact the bristles and push the legs outward in such a manner that the nail polish remover liquid on the bristles will remove the nail polish from the fingernails. After a number of uses, the legs tend to spread apart so that a person can get a fingernail caught on the end of the leg, breaking the nail or a portion of the nail during the brushing motion. U.S. Pat. No. 3,316,922 discloses a nail polish remover device in which a circular brush with a circular open center is mounted on a group of abutments extending inwardly from an insert surface. The brush member is positioned on the abutments and the brush stem is moved against the abutments to snap into an inclined position.

The above cited patents have been specifically directed towards suspending the brush element within a receptacle. Thus the brush element when suspended within the receptacle does not provide the most efficient way of removing the nail polish from the fingernail, as well as being comprised of multiple pieces of separate construction and assembly which add to the cost of the unit and make the unit more difficult to assemble. Furthermore, there are reservations about the use of a sponge or sponge-like product in beauty salons because of the occurrence of bacterial collection and growth in the sponge.

SUMMARY OF THE INVENTION

The present invention provides for a unique single piece injected molded unit which provides for better fingernail cleaning and conditioning through the use of molded brush bristles. The nail polish remover container has integral flexible bristles positioned in a spaced relationship for maximum interaction with a fingernail.

Thus the bristles are positioned in a fixed relationship to eliminate catching of the bristles on the fingernail when the finger is inserted into the brush member. Each bristle member is spaced in bristle rows which are separated to allow a constant flow of nail polish remover or conditioner into the brushing area during the brushing period and continuous circulation of the liquid throughout the container. The container can be easily cleaned or sterilized to remove any bacterial or viral growths as well as any cuticle material that has been torn or pulled off by the brush. This is of particular importance where the cuticle area may be open and/or bleeding due to job related tearing of the cuticles or simply fingernail biting or picking. Such open wound areas could provide transmission of dangerous virus such as AIDS. Thus, the present invention provides a simple integrally molded container.

These and other objects, advantages and novel features of the present invention become apparent when considered with the teachings contained in the detailed disclosure along with the accompanying drawings.

DETAILED DESCRIPTION OF THE PREFERRED EMBODIMENT

Figure 1:
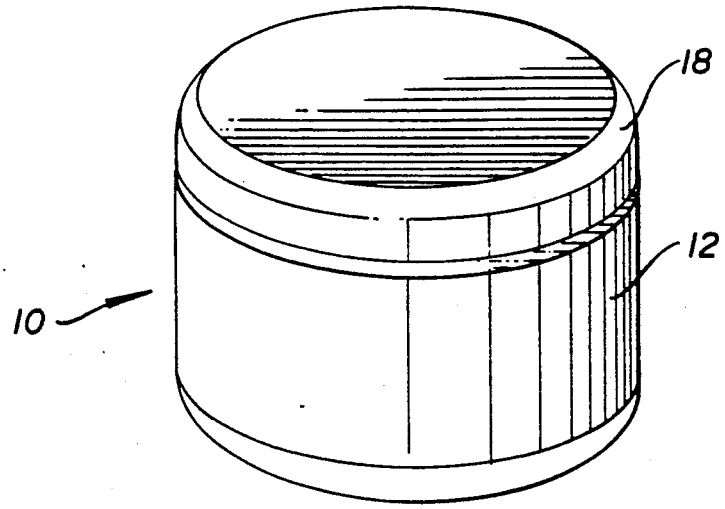
FIG. 1 is a perspective view of the nail polish remover receptacle of the present invention.
Figure 2:
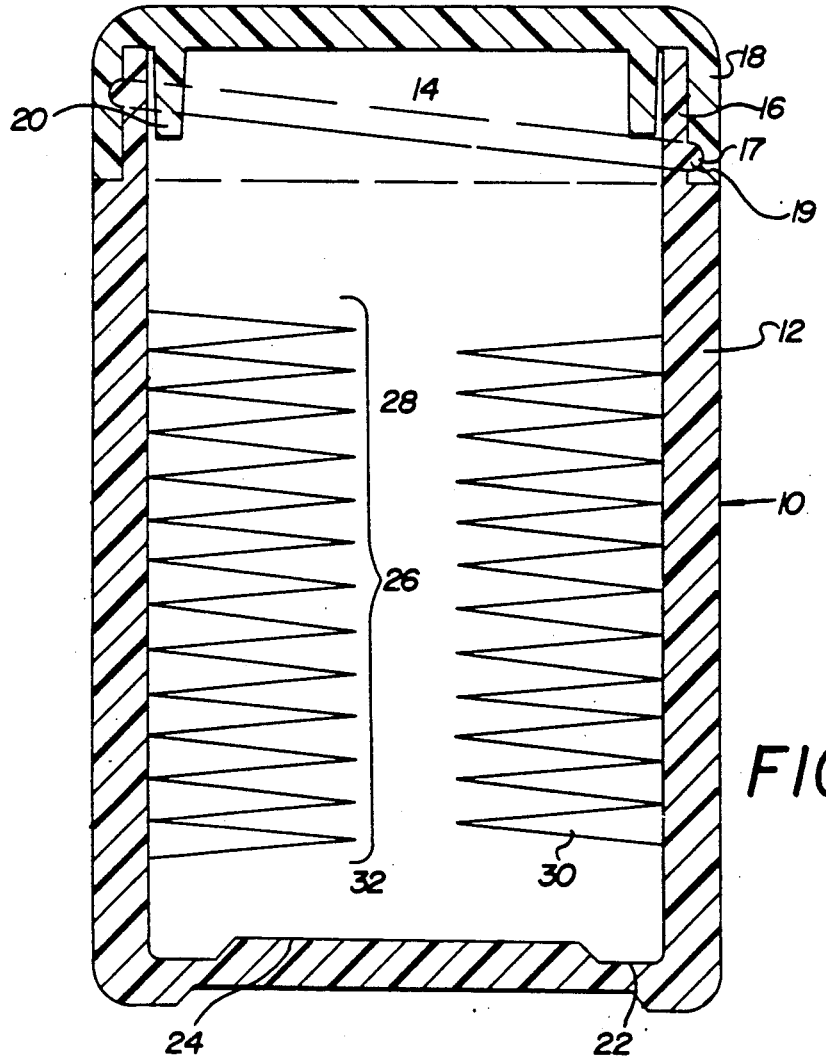
FIG. 2 is an enlarged cross-sectional view of the nail polish remover receptacle shown in FIG. 1, showing the integral brush.
Figure 3:
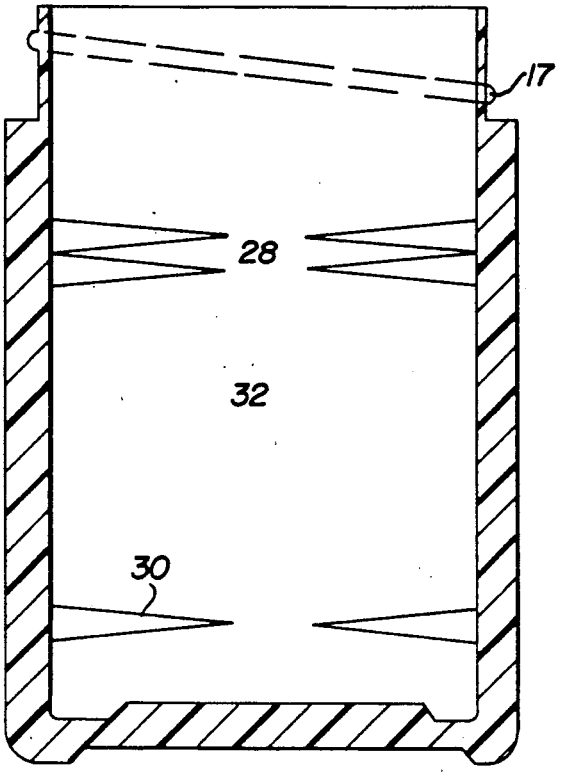
FIG. 3 is a cross sectional view of the container body of FIG. 2 with brush bristles partially removed.
Figure 4:
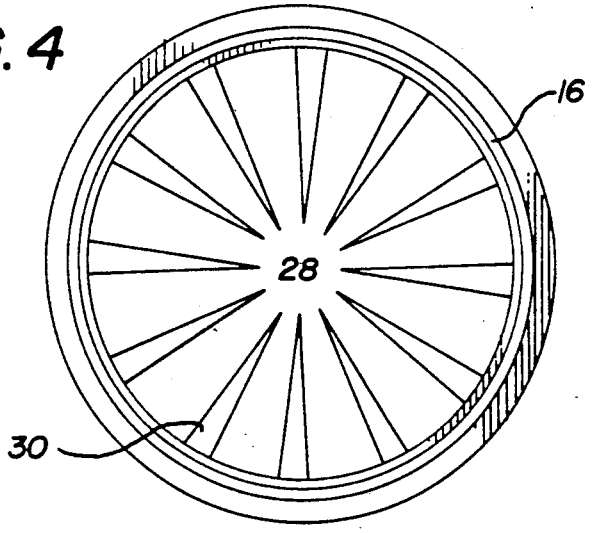
FIG. 4 is a top plan view of the container body shown in FIG. 3.
Figure 5:
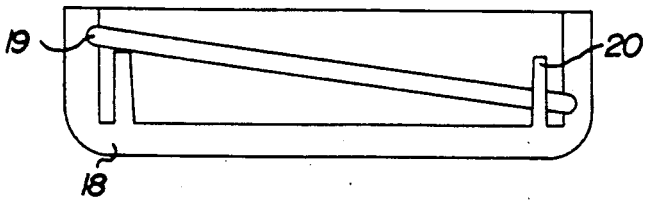
FIG. 5 is a cross section of the cap used with the container body of FIG. 3.

The preferred embodiment and best mode of the invention is shown in FIGS. 1 through 5. As shown in FIG. 2, the container is generally designated as 10 and comprises a cylindrical plastic receptacle 12 having a circular opening 14 with a stepped threaded neck portion 16. The neck portion 16 defines a continuous thread 17 which receives a grooved or channeled cap 18 to provide a closed container. The cap 18 is formed with an inner annular rib 20 which extends down into the circular opening 14 and chamber 22 of the receptacle adjacent the stepped neck portion 16. This rib provides additional support for the cap and keeps the stepped neck portion 16 from bowing inward so that the cap fits flush on the receptacle.

The thread 17 is formed on the neck portion outside surface opposite the cap threading groove or channel 19. The receptacle body has formed on its inner bottom surface 22 a circular stop 24. The body of the receptacle defines a plurality of spaced rows of bristles 26 which extend inward into the receptacle chamber 32 to define a finger insertion area 28. Each row 26 preferably consists of twenty-four triangular shaped bristle members 30 which are individually spaced apart. However, the bristle members can range in number from 20 to 40 depending on the finger engagement desired. There are twelve rows of bristles 26 equally spaced around the circumference of the interior of the cylindrical receptacle; however, the number of rows can range from ten to twenty. The spaces between the bristles 30 and the rows of bristles 26 allow nail polish remover or conditioner placed within the receptacle to freely flow into the brush area. The brush thus has a full 360° radius and has no metal parts or sponge-like foam.

The entire construction of the container and integral brush structure is preferably polyethylene and permits a finger to be inserted and withdrawn from the interior of the brush member. The composition of the brush structure and receptacle is such that it is virtually impervious to the deleterious effects of nail polish remover in both liquid and vapor phase.

When nail polish remover solvent or conditioner is added to or contained within the receptacle, a finger is placed down into the brush member so that the brush bristles engage the hardened polish on the fingernail to abrade or fracture the surface of the polish. This fracturing in connection with additional bristles engaging the polish and the action of the polish remover solvent removes the polish from the nail surface. Upon removal of the finger from the receptacle, the bristles revert back to their previous memory position.

If desired, the solvent material can be emptied from the receptacle and the receptacle washed out as desired and reused in any manner desired to provide optimum cleanliness and hygiene.

In the foregoing description, the invention has been described with reference to a particular preferred embodiment, although it is to be understood that specific details shown are merely illustrative, and the invention may be carried out in other ways without departing from the true spirit and scope of the following claims:

What is claimed is:

1. A manicuring device adapted for cleaning the fingernail of a finger comprising a plastic, integrally molded cylindrical container body with a closed end defining a chamber with a closed bottom portion and an open top portion of sufficient width to receive a finger, the inner surface of the closed end defining an annular channel adjacent the inner surface of the container body, said top portion being stepped and forming thread means, a flexible brush means integrally molded to the inner surface of said container body comprising a plurality of bristles extending radially inward around from the inner surface of the container body into said chamber and defining a circumferentially complete central passageway allowing a finger to pass therethrough while said finger engages said bristles and be guided into the interior of said chamber, said bristles being spaced in a plurality of rows circumferentially positioned around the inner surface of the container body and cap means removably mounted to said container.

2. A manicuring device as claimed in claim 1 wherein each said bristle means is triangular in configuration.

* * * * *